US009796515B2

(12) United States Patent
Terayama

(10) Patent No.: US 9,796,515 B2
(45) Date of Patent: Oct. 24, 2017

(54) PACKAGE WITH SEALED AIR PORTION FOR FLOATATION

(71) Applicant: Toppan Printing Co., Ltd., Tokyo (JP)

(72) Inventor: Takashi Terayama, Tokyo (JP)

(73) Assignee: TOPPAN PRINTING CO., LTD, Tokyo (JP)

( * ) Notice: Subject to any disclaimer, the term of this patent is extended or adjusted under 35 U.S.C. 154(b) by 0 days.

(21) Appl. No.: 15/126,567

(22) PCT Filed: Mar. 31, 2015

(86) PCT No.: PCT/JP2015/001869

§ 371 (c)(1),
(2) Date: Sep. 15, 2016

(87) PCT Pub. No.: WO2015/151520

PCT Pub. Date: Oct. 8, 2015

(65) Prior Publication Data

US 2017/0081107 A1 Mar. 23, 2017

(30) Foreign Application Priority Data

Apr. 4, 2014 (JP) ..... 2014-077606

(51) Int. Cl.

| | |
|---|---|
| ***B65D 81/34*** | (2006.01) |
| ***B65D 75/56*** | (2006.01) |
| ***B65D 65/40*** | (2006.01) |
| ***B65D 75/30*** | (2006.01) |

(52) U.S. Cl.

CPC ..... *B65D 81/3415* (2013.01); *B65D 65/40* (2013.01); *B65D 75/30* (2013.01); *B65D 75/563* (2013.01); *B65D 75/566* (2013.01)

(58) Field of Classification Search

CPC ..... B65D 33/00; B65D 65/40; B65D 75/30; B65D 75/56; B65D 75/563; B65D 75/566; B65D 75/58; B65D 75/5827; B65D 75/5883; B65D 81/34; B65D 81/3415; B65D 75/52

USPC ..... 206/484–484.2

See application file for complete search history.

(56) References Cited

U.S. PATENT DOCUMENTS

| | | | | |
|---|---|---|---|---|
| 7,444,795 | B2 * | 11/2008 | Yasuhira | B65B 43/465 53/410 |
| 7,658,286 | B2 * | 2/2010 | Murray | B65D 75/5883 383/40 |
| 8,434,637 | B2 * | 5/2013 | Mita | B65D 81/3461 383/66 |
| 2005/0255200 | A1 * | 11/2005 | Takahagi | B65D 75/008 426/113 |

FOREIGN PATENT DOCUMENTS

| | | |
|---|---|---|
| FR | 2953813 A1 | 6/2011 |
| JP | S51033512 U1 | 8/1976 |
| JP | S53033512 U1 | 3/1978 |

OTHER PUBLICATIONS

Written Opinion and the International Search Report for International Patent Application No. PCT/JP2015/001869, dated Jun. 30, 2015.

* cited by examiner

*Primary Examiner* — Bryon Gehman
(74) *Attorney, Agent, or Firm* — Squire Patton Boggs (US) LLP

(57) ABSTRACT

A package has an air sealed portion near an outer edge of the package to allow part of the package to float above water.

6 Claims, 3 Drawing Sheets

PRIOR ART

PACKAGE WITH SEALED AIR PORTION FOR FLOATATION

TECHNICAL FIELD

The present invention relates to a package in which contents are stored in a flexible packaging bag, and, in particular, to a package for which usability and safety are taken into consideration for heating the package, as it is, in hot water.

BACKGROUND ART

To date, a retort sterilization package in which contents such as foods are stored in a flexible packaging bag impermeable to oxygen or water vapor and which is subjected to retort sterilization and allows long term storage, has been known. In this kind of package, aluminum foil is often used for the packaging bag in order to ensure gas barrier properties, and, in this case, the package cannot be directly heated as it is by a microwave oven.

The contents stored in such a package are heated in two methods. One of the methods is a method in which the package is unsealed, and contents are taken out and heated by using a pot or a microwave oven. The other of the methods is a method in which the package is heated as it is in hot water.

In recent years, a packaging material in which, for example, an inorganic vapor deposited film having gas barrier properties is used instead of aluminum foil, has been developed, and a package which can be heated as it is by a microwave oven, is also put into practical use. The method in which heating in hot water is performed is advantageous in that the method can be used in an outdoor place where a microwave oven cannot be used, and a pot or a container is not soiled. Therefore, the method in which heating in hot water is performed is still widely used.

In a case where the package is heated in hot water, if the package is held by chopsticks or the like in order to take out the package from boiled water when the heating has ended, the chopsticks may slip and it may be difficult to hold the package. If the package is held with a bare hand, fingertips may contact with the boiled water or the boiled water may be splashed, so that the hand or the fingertips may be burned.

Patent Literature 1 discloses a packaging bag, for cooked foods, for solving the problems. As shown in FIG. 6, the packaging bag has, at a corner portion of a seal portion, a through hole (7) into which a chopstick can be inserted. The packaging bag can be taken out from boiled water without contact with a hand by the tip of the chopstick being inserted into the hole (7) and the hole (7) being caught with the tip of the chopstick.

However, in a case where the package as shown in FIG. 6 is actually produced and an experiment is made, the package floats in boiled water. Therefore, it is found that a problem arises that it is difficult to just insert the tip of a chopstick into the hole, and, even if the tip of the chopstick can be inserted therein, the hole is not easily caught with the tip of the chopstick since the package is horizontally positioned.

CITATION LIST

Patent Literature

[PTL 1] Japanese Laid-Open Utility Model Publication No. 53-33512

SUMMARY OF THE INVENTION

Problems to be Solved by the Invention

An object of the present invention is to provide a package that can be safely taken out from boiled water with stability when heated in hot water, and that can allow contents therein to be uniformly heated.

Solution to the Problems

The present invention is directed to a package which includes a laminate having a base layer, a barrier layer, and a sealant layer, and has a seal portion formed by the sealant layers of the laminates being disposed so as to oppose each other, and circumferential edges being heat-sealed. The seal portion has one air sealed portion in which air is enclosed. A distance from an outer edge of the air sealed portion to an outer edge of the package is greater than or equal to 2 mm.

Advantageous Effects of the Invention

According to the present invention, a package that can be safely taken out from boiled water with stability when heated in hot water, and that can allow contents therein to be uniformly heated, can be implemented.

DESCRIPTION OF EMBODIMENTS

Hereinafter, a package according to one embodiment of the present invention will be described in detail with reference to the drawings.

Figure 1:
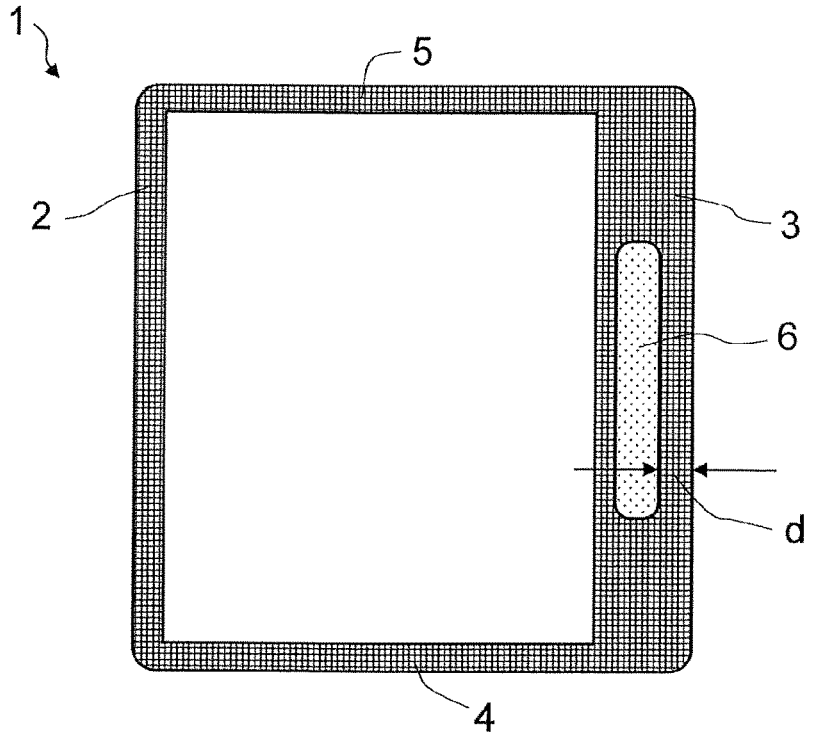
FIG. 1 is a schematic diagram illustrating a package according to one embodiment of the present invention.

FIG. 1 is a schematic diagram illustrating a package (1) according to one embodiment of the present invention. In this example, one air sealed portion (6) is provided in one side seal portion (3) of the package (1). The air sealed portion (6) is not provided in the other side seal portion (2), a bottom seal portion (4), and a top seal portion (5). Further, in general, the top seal portion (5) is sealed after contents are stored.

Figure 2:
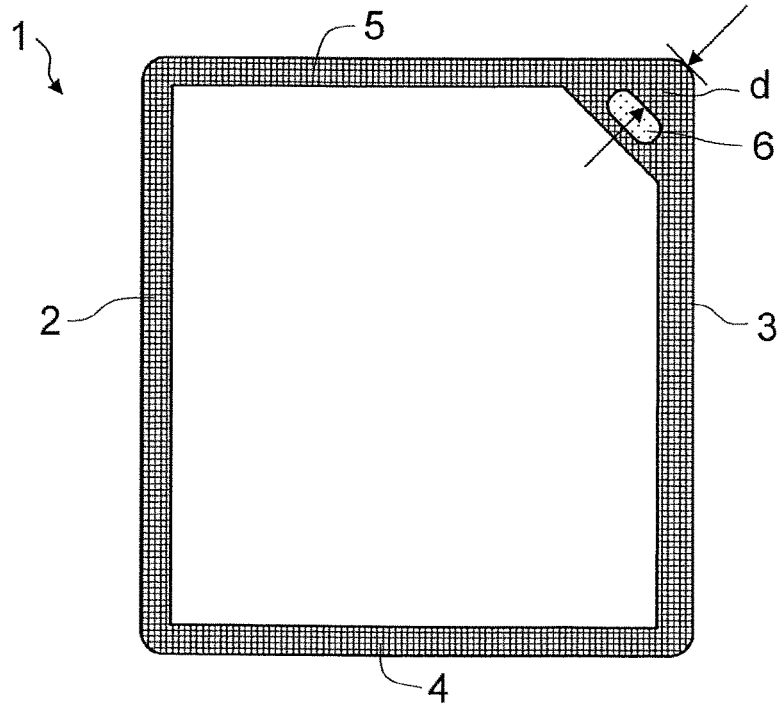
FIG. 2 is a schematic diagram illustrating a package according to another embodiment of the present invention.
Figure 3:
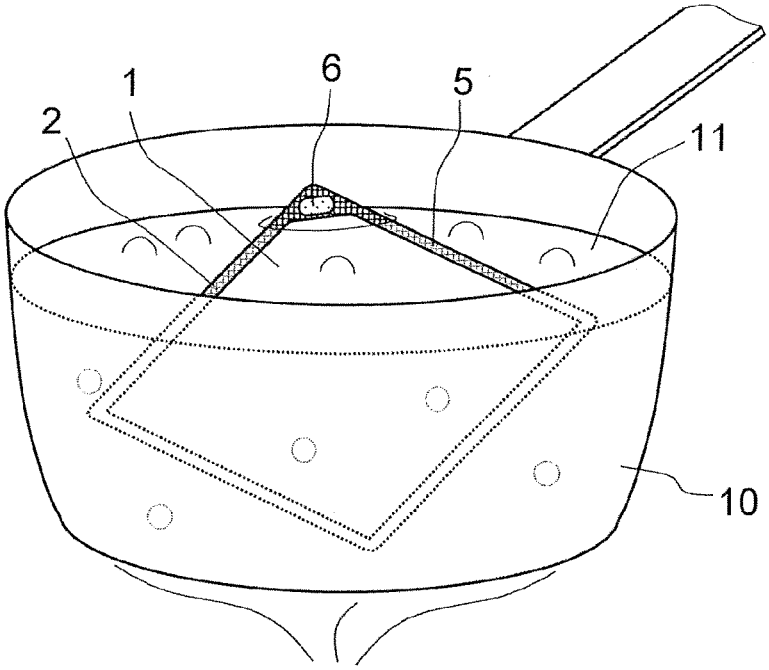
FIG. 3 is a schematic diagram illustrating a state where the package according to the embodiment is heated in a pot in hot water.

FIG. 2 is a schematic diagram illustrating a package (1) according to another embodiment of the present invention. In the example shown in FIG. 2, the air sealed portion (6) is provided at one of corner seal portions of the package (1). In a case where the air sealed portion (6) is thus provided at one of the corner seal portions, when the entirety of the package (1) is heated in hot water in a pot (10) that contains boiled water (11) as shown in FIG. 3, the air sealed portion (6) acts as a float, and a seal portion positioned outward of the air sealed portion (6) floats above the water surface.

In this case, when a distance (d) from the outer edge of the air sealed portion (6) to the outer edge of the package (1) is greater than or equal to 2 mm, this portion can be pinched with fingertips. When the distance (d) is greater than or equal to 10 mm, the pinching can be more easily performed, and this is more preferable.

Further, a portion having the air sealed portion (6) floats above water surface, whereby a portion of the package (1) in which contents are stored, sinks in hot water. Therefore, a secondary effect that the contents are uniformly heated, can be obtained.

As shown in FIG. 1, when the air sealed portion (6) is provided in the seal portion (3), of the package (1), at one of the side portions, the one of the side portions of the package (1) at which the air sealed portion (6) is provided floats above water surface, and the opposite side portion sinks in the water. Therefore, a portion to be pinched is elongated, and pinching of the package (1) can be facilitated, and the contents are more uniformly heated.

Further, as shown in FIG. 2 and FIG. 3, in a case where the air sealed portion (6) is provided at one of the corner seal portions of the package (1), a distance from the center of gravity of the package (1) to the air sealed portion (6) is increased as compared to a case where the air sealed portion (6) is provided at the seal portion, of the package (1), at one of the side portions. Therefore, even when the air sealed portion is small, floating effect is sufficiently exhibited due to the principle of leverage. Therefore, a space required for the air sealed portion (6) can be reduced, and a packaging material may not be wasted.

Figure 4:
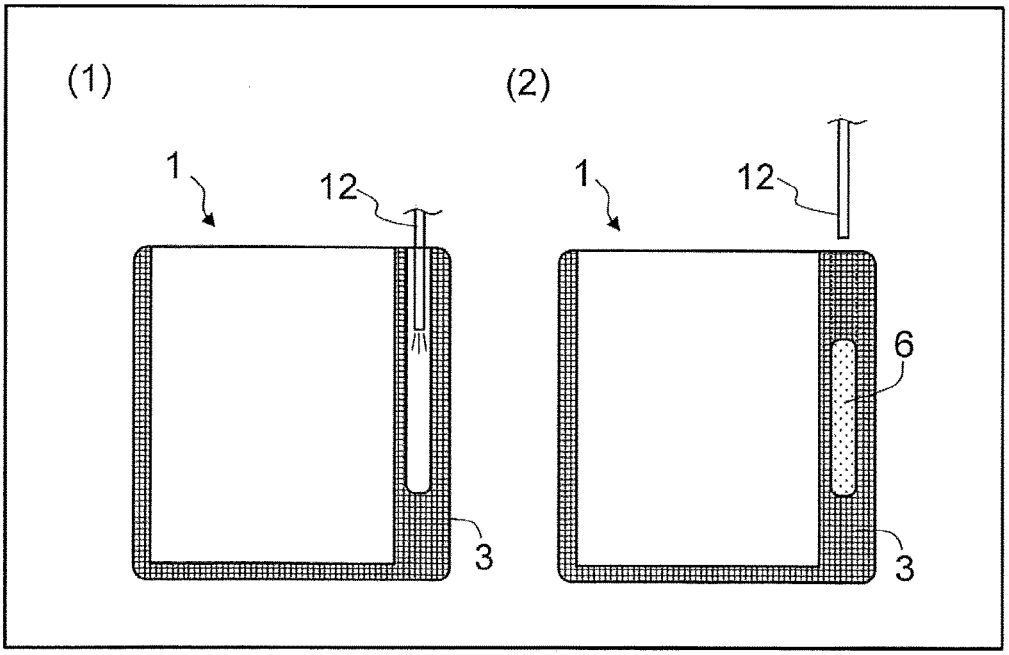
FIG. 4 a schematic diagram illustrating an example of a method for forming an air sealed portion.

As a method for forming the air sealed portion (6), there are several methods. An exemplary method that is schematically illustrated in FIG. 4 is a method in which an air nozzle (12) is used. As shown in (1) of FIG. 4, a portion to be formed as the air sealed portion (6) remains unsealed, and the air nozzle (12) is inserted into the portion to inject air.

Subsequently, as shown in (2) of FIG. 4, the air nozzle is removed, and the passage is immediately sealed, thereby forming the air sealed portion (6). A part of the injected air may escape in a short time period before the sealing is completed unless a specific treatment is performed. However, a small amount of air that remains in the air sealed portion (6) is sufficient. When the package (1) is heated in hot water, a small amount of air sufficiently expands and acts as a float. Therefore, there is not any problem.

Also in the example shown in FIG. 2, in the same method as the method shown in FIG. 4, a non-sealed portion is left, and is sealed and closed after air is injected, whereby the air sealed portion (6) can be formed, which is not specifically shown.

The air sealed portion (6) may be formed before contents are stored after the packaging bag has been produced, or formed after contents are stored after the packaging bag has been produced.

The shape of the packaging bag is not limited to the shape of the four side seal bag as shown in FIG. 1 and FIG. 2, and the packaging bag may be formed into a three side seal bag, a a pillow bag type, a standing pouch, or the like, and the shape thereof is not specifically restricted.

Subsequently, a structure of a laminate used for the package according to the present invention will be described.

As a base layer, a synthetic resin film formed of, for example, biaxially oriented polypropylene resin (OPP), polyethylene terephthalate resin (PET), or polyamide resin such as nylon-6 and nylon-66, is typically used.

As a barrier layer, a gas barrier film such as: a polyvinylidene chloride film; a polyvinyl alcohol film; an ethylene-vinyl alcohol copolymer film; a gas barrier nylon film; and a gas barrier polyethylene terephthalate (PET) film, a metal vapor deposited film obtained by a metal such as aluminium being deposited on a PET film or the like, an inorganic oxide vapor-deposited film obtained by an inorganic oxide such as aluminium oxide or silicon oxide being deposited on a PET film, a gas barrier coating layer formed of: polyvinylidene chloride coating; a coating that contains a water-soluble resin and an inorganic layered compound; a coating obtained by reaction of a metal alkoxide or a hydrolysate thereof with an isocyanate compound; or the like, or a metal foil such as aluminum foil, or the like, can be used.

As a sealant layer, a polyolefin resin is typically used. When no retort sterilization is performed, an ethylene-based resin such as a low-density polyethylene resin (LDPE), a medium-density polyethylene resin (MDPE), a linear low-density polyethylene resin (LLDPE), an ethylene-vinyl acetate copolymer (EVA), an ethylene-α-olefin copolymer, or an ethylene-methacrylic acid resin copolymer, can be used.

When retort sterilization is performed, a polypropylene resin (CPP) having a high heat-resistance is typically used. For example, a polypropylene-based resin such as: a propylene-ethylene random copolymer; a propylene-ethylene block copolymer; and a propylene-α-olefin copolymer, or a resin obtained by the above-described resin being blended with PP, is used.

In the package according to the present embodiment, the air sealed portion in which air is enclosed is provided in the seal portion positioned at a circumferential edge. Therefore, when the package is heated in hot water, air enclosed in the air sealed portion expands and acts as a float, whereby the seal portion positioned outward of the air sealed portion floats above the water surface. When the distance from the outer edge of the air sealed portion to the outer edge of the package is greater than or equal to 2 mm, the seal portion that projects on the water surface can be pinched by fingers. Therefore, the package can be safely pinched by a hand with easiness. Further, as a result of the seal portion having the air sealed portion being floated, a portion in which contents are stored sinks in the water. Therefore, the contents are uniformly heated.

Further, in a case where the air sealed portion is provided in the seal portion positioned at one of the sides of the package, when the package is heated in hot water, a portion of the package at the one of the sides on which the air sealed portion is provided floats above the water surface, and a portion thereof on the opposite side sinks in the water. Therefore, a portion to be pinched is elongated, and the package can be more easily pinched and the contents are more uniformly heated.

Further, in a case where the air sealed portion is provided at one of the corner seal portions of the package, a distance from the center of gravity of the package to the air sealed portion is increased as compared to a case where the air sealed portion is provided at the seal portion, of the package, at one of the side portions. Therefore, even when the air sealed portion is small, floating effect is sufficiently exhibited due to the principle of leverage. Therefore, a space required for the air sealed portion can be reduced, and a packaging material may not be wasted. Further, when the package is heated in hot water, a corner portion of the package in which the air sealed portion is provided floats above the water surface, and a portion thereof on the corner portion that is positioned diagonally with respect to the corner portion in which the air sealed portion is provided, sinks in the water. Therefore, the corner portion in which the air sealed portion is provided, projects on the water surface, and the package can be more easily pinched, and the contents are more uniformly heated.

When the distance from the outer edge of the air sealed portion to the outer edge of the package is greater than or equal to 10 mm, the seal portion can be pinched by a hand with enhanced easiness. Therefore, the package can be more safely taken out from boiled water.

Hereinafter, the package according to the present invention will be specifically described based on examples.

Example 1

A transparent gas barrier film (manufactured by TOPPAN PRINTING CO., LTD., trade name: GL film) obtained by aluminium oxide being deposited on a PET film having a thickness of 12 μm, a biaxially oriented nylon film having a thickness of 15 μm, and a CPP film, as a sealant layer, having a thickness of 70 μm were adhered to each other by a dry lamination with the use of an urethane-based adhesive, to form a laminate.

The CPP surfaces of the laminates were arranged so as to oppose each other, and the three side portions except for the upper side portion were heat-sealed, and the air sealed portion was formed in the side seal portion in the method as shown in FIG. 4, and curry was then stored as contents through the opening formed on the upper side portion, and the upper side portion was heat-sealed, to produce a package having the shape as shown in FIG. 1. The distance from the outer edge of the air sealed portion to the outer edge of the package was 2 mm.

(Evaluation)

The obtained package was subjected to retort sterilization at 120° C. for 10 minutes, and was temporarily cooled, and was then heated again in boiling water for five minutes. The state was stable while the package was heated in the hot water such that the air sealed portion floated, and a portion of the package in which contents were stored sank in the hot water. After the end of the heating, the seal portion that floated above the water surface was pinched by a hand, and the package was able to be easily taken out without special feeling of hotness.

Example 2

A package was produced in the same manner as in Example 1 except that the package had the shape shown in FIG. 2, and the same evaluation as in Example 1 was performed. Similarly to Example 1, the evaluation was good for both a state during heating in hot water, and taking-out after end of the heating.

Example 3

A package was produced in the same manner as in Example 1 except that the distance from the outer edge of the air sealed portion to the outer edge of the package was 3 mm, and the same evaluation as in Example 1 was performed. Similarly to Example 1, the evaluation was good for both a state during heating in hot water, and taking-out after end of the heating.

Example 4

A package was produced in the same manner as in Example 1 except that the distance from the outer edge of the air sealed portion to the outer edge of the package was 4 mm, and the same evaluation as in Example 1 was performed. Similarly to Example 1, the evaluation was good for both a state during heating in hot water, and taking-out after end of the heating.

Example 5

A package was produced in the same manner as in Example 1 except that the distance from the outer edge of the air sealed portion to the outer edge of the package was 5 mm, and the same evaluation as in Example 1 was performed. Similarly to Example 1, the evaluation was good for both a state during heating in hot water, and taking-out after end of the heating.

Example 6

A package was produced in the same manner as in Example 1 except that the distance from the outer edge of the air sealed portion to the outer edge of the package was 6 mm, and the same evaluation as in Example 1 was performed. Similarly to Example 1, the evaluation was good for both a state during heating in hot water, and taking-out after end of the heating.

Example 7

A package was produced in the same manner as in Example 1 except that the distance from the outer edge of the air sealed portion to the outer edge of the package was 7 mm, and the same evaluation as in Example 1 was performed. Similarly to Example 1, the evaluation was good for both a state during heating in hot water, and taking-out after end of the heating.

Example 8

A package was produced in the same manner as in Example 1 except that the distance from the outer edge of the air sealed portion to the outer edge of the package was 8 mm, and the same evaluation as in Example 1 was performed. Similarly to Example 1, the evaluation was good for both a state during heating in hot water, and taking-out after end of the heating.

Example 9

A package was produced in the same manner as in Example 1 except that the distance from the outer edge of the air sealed portion to the outer edge of the package was 9 mm, and the same evaluation as in Example 1 was performed. Similarly to Example 1, the evaluation was good for both a state during heating in hot water, and taking-out after end of the heating.

Example 10

A package was produced in the same manner as in Example 1 except that the distance from the outer edge of the air sealed portion to the outer edge of the package was 10 mm, and the same evaluation as in Example 1 was performed. The evaluation was good for a state during heating in hot water, similarly to Example 1. The package was able to be taken out more easily than the package in Example 1, and evaluation for taking-out after end of the heating was thus better than that in Example 1.

Example 11

A package was produced in the same manner as in Example 1 except that the distance from the outer edge of the air sealed portion to the outer edge of the package was 11 mm, and the same evaluation as in Example 1 was performed. The evaluation was good for a state during heating in hot water, similarly to Example 1. The package was able to be taken out more easily than the package in Example 1, and evaluation for taking-out after end of the heating was thus better than that in Example 1.

Example 12

A package was produced in the same manner as in Example 1 except that the distance from the outer edge of the air sealed portion to the outer edge of the package was 12 mm, and the same evaluation as in Example 1 was performed. The evaluation was good for a state during heating in hot water, similarly to Example 1. The package was able to be taken out more easily than the package in Example 1, and evaluation for taking-out after end of the heating was thus better than that in Example 1.

Comparative Example 1

Figure 5:
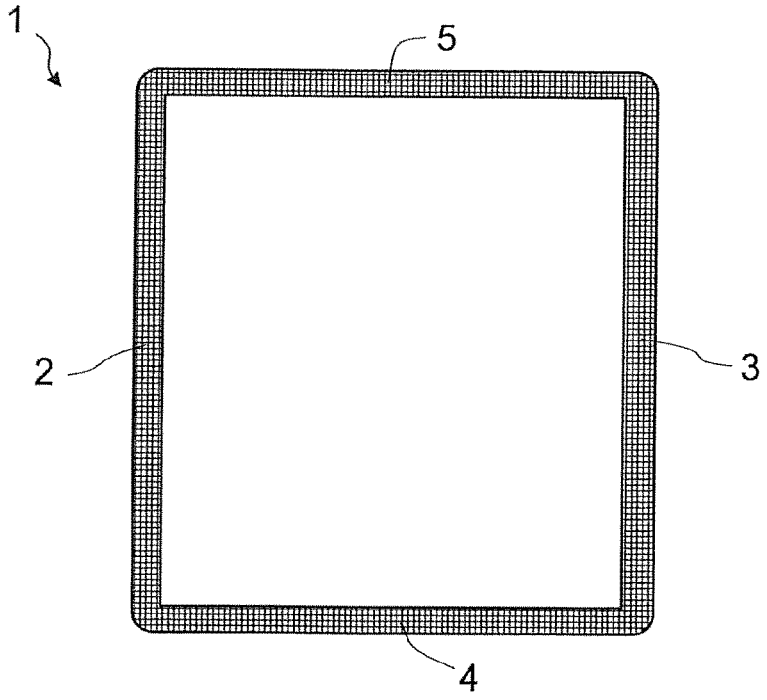
FIG. 5 is a schematic diagram illustrating an example of a conventional package.

A packaging bag having no air sealed portion was produced as shown in FIG. 5 by using the same type of laminate as in Example 1, and the same evaluation as in Example 1 was performed. As a result, when heated in hot water, the package floated in the hot water and a portion of the package in which contents were stored partially floated above the water surface, and the temperature thus varied in the contents. Taking-out after end of the heating in hot water was such that the taking-out was not easily performed since the package was not able to be directly pinched by a hand, and pinching and taking out the package by chopsticks was attempted, but the chopsticks slipped and it was difficult to pinch the package.

Comparative Example 2

Figure 6:
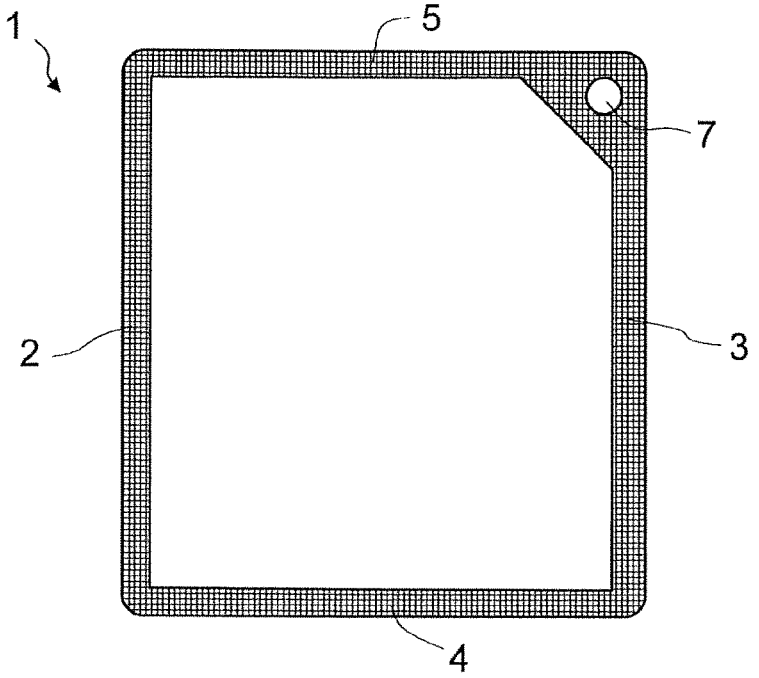
FIG. 6 is a schematic diagram illustrating an example of a conventional package.

A packaging bag having no air scaled portion and having a hole was produced as shown in FIG. 6 by using the same type of laminate as in Example 1, and the same evaluation as in Example 1 was performed. As a result, when heated in hot water, the package floated in the hot water and a portion of the package in which contents were stored partially floated above the water surface, and the temperature thus varied in the contents. Taking-out after end of the heating in hot water was such that the taking-out was not easily performed since the package was not able to be directly pinched by a hand, and inserting a chopstick in the hole and taking out the package was attempted, but it was difficult to catch the hole with the tip of the chopstick.

Comparative Example 3

A package was produced in the same manner as in Example 1 except that the distance from the outer edge of the air sealed portion to the outer edge of the package was 1 mm, and the same evaluation as in Example 1 was performed. As a result, the evaluation was good for a state during heating in hot water, similarly to Example 1. However, the taking-out was such that pinching the package directly by a hand was attempted, but the width of the seal portion was narrow, hotness was felt by the hand, and the package was not able to be taken out by the hand. Therefore, pinching and taking out the package with a chopstick was attempted, but the chopstick slipped and it was difficult to pinch the package, so that the taking-out was not easily performed.

(Evaluation Result)

As described above, it was confirmed that the package according to Examples 1 to 12 in which one air sealed portion in which air was enclosed was provided in a seal portion, and the distance from the outer edge of the air sealed portion to the outer edge of the package was greater than or equal to 2 mm, was advantageous in that the package was able to be easily taken out after heated in hot water, and variation in heating was reduced.

INDUSTRIAL APPLICABILITY

The package according to the present invention can be used as, for example, a package that is heated in hot water.

DESCRIPTION OF THE REFERENCE CHARACTERS

1 package
2 side seal portion
3 side seal portion
4 bottom seal portion
5 top seal portion
6 air sealed portion
7 hole
10 pot
11 boiled water
12 air nozzle

The invention claimed is:

1. A package to be heated in hot water, the package comprising:

a seal portion at a circumferential edge of the package; and a portion which has contents stored therein and is surrounded by the seal portion, wherein the seal portion has one air sealed portion in which air is enclosed, a distance from an outer edge of the air sealed portion to an outer edge of the package is greater than or equal to 2 mm, and the air sealed portion is constructed such that when the package is heated in hot water, the air sealed portion will float above the hot water surface to position the seal portion outward of the hot water surface.

2. The package according to claim 1, wherein the air sealed portion is provided in the seal portion positioned at one side of the package.

3. The package according to claim 2, wherein the distance from the outer edge of the air sealed portion to the outer edge of the package is greater than or equal to 10 mm.

4. The package according to claim 1, wherein the air sealed portion is provided in the seal portion positioned at one corner of the package.

5. The package according to claim 4, wherein the distance from the outer edge of the air sealed portion to the outer edge of the package is greater than or equal to 10 mm.

6. The package according to claim 1, wherein the distance from the outer edge of the air sealed portion to the outer edge of the package is greater than or equal to 10 mm.

* * * * *